US006273512B1

(12) United States Patent
Rajewski

(10) Patent No.: US 6,273,512 B1
(45) Date of Patent: Aug. 14, 2001

(54) HYDROVAC EXCAVATING BLAST WAND

(76) Inventor: Robert C. Rajewski, R.R. #1, Donalda, Alberta (CA), T0B 1H0

( * ) Notice: Subject to any disclaimer, the term of this patent is extended or adjusted under 35 U.S.C. 154(b) by 0 days.

(21) Appl. No.: 09/392,738

(22) Filed: Sep. 9, 1999

(51) Int. Cl.[7] ..... E21C 37/06
(52) U.S. Cl. ..... 299/17; 37/323; 175/67
(58) Field of Search ..... 299/16, 17, 81.3; 175/67, 208, 424; 37/323, 905

(56) References Cited

U.S. PATENT DOCUMENTS

| | | | | |
|---|---|---|---|---|
| 2,605,090 | * | 7/1952 | Jacobsen | 299/17 |
| 2,678,203 | * | 5/1954 | Huff | 299/17 |
| 3,934,659 | * | 1/1976 | Tsiferov | 175/14 |
| 4,240,664 | * | 12/1980 | Mahyera et al. | 299/17 |
| 4,412,394 | | 11/1983 | Coker | 37/57 |
| 4,437,525 | | 3/1984 | O'Hanlon et al. | 175/218 |
| 4,753,549 | * | 6/1988 | Shook et al. | 299/17 |
| 4,761,037 | | 8/1988 | Medeot | 299/1 |
| 4,761,039 | * | 8/1988 | Hilaris | 299/16 |
| 4,768,709 | * | 9/1988 | Yie | 175/67 |
| 4,776,731 | | 10/1988 | Briggs et al. | 406/153 |
| 4,930,586 | * | 6/1990 | Turin et al. | 175/67 |
| 4,936,031 | | 6/1990 | Briggs et al. | 406/96 |
| 4,991,321 | | 2/1991 | Artzberger | 37/62 |
| 5,016,717 | * | 5/1991 | Simons et al. | 175/67 |
| 5,098,164 | | 3/1992 | Savanick et al. | 299/17 |
| 5,212,891 | * | 5/1993 | Schuermann et al. | 37/62 |
| 5,255,959 | | 10/1993 | Loegel | 299/17 |
| 5,295,317 | * | 3/1994 | Perrott | 37/905 |
| 5,299,370 | * | 4/1994 | Gyori et al. | 37/905 |
| 5,439,343 | * | 8/1995 | Watson | 414/744.3 |
| 5,536,200 | * | 7/1996 | Kiess | 451/102 |
| 6,202,330 | * | 3/2001 | Bolton | 37/905 |

* cited by examiner

*Primary Examiner*—David Bagnell
*Assistant Examiner*—Nathan Mammen
(74) *Attorney, Agent, or Firm*—Anthony R. Lambert

(57) ABSTRACT

A hydrovac wand is provided with a crossfire nozzle arrangement that reduces thrust to the wand operator, and that has a spray pattern that eliminates spray back. A pair of jets erode a hole while two other jets push the debris back to a suction hose. Two high pressure swivels are provided at the end of the wand to allow the wand to rotate in all directions without binding. Boom controls are placed on the wand to maximize digging rates.

9 Claims, 5 Drawing Sheets

HYDROVAC EXCAVATING BLAST WAND

FIELD OF THE INVENTION

This invention relates to apparatus used for hydrovac excavation.

BACKGROUND OF THE INVENTION

In hydrovac excavation, a jet of water is blasted into soil to liquify the soil and then the liquified soil is sucked up using a vacuum truck. The jet of water is directed into the soil using a blast wand that is manually operated. Various types of wand have been used for this purpose. Typically, the wand consists of a pipe with a valve on one end and blast nozzles on the other end. The blast nozzles generally blast straight out, in the direction of the pipe, so the thrust of the nozzles pushes against the pipe handle, thus tiring the operator. Also, with the nozzles blasting straight out, a hole is created in the soil and rebounding water shoots directly back at the operator's face and body. This makes the wands dirty to use, and potentially dangerous due to soil fragments shooting into the face and eyes of the operator.

SUMMARY OF THE INVENTION

These difficulties with prior art hydrovac wands are addressed with the following invention.

According to an aspect of the invention, a hydrovac wand is provided with a crossfire nozzle arrangement that reduces thrust to the wand operator, and that has a spray pattern that eliminates spray back. In another aspect of the invention, a pair of jets erode a hole while two other jets push the debris back to a suction hose. In another aspect of the invention, a two high pressure swivels are provided at the end of the wand to allow the wand to rotate in all directions without binding. In a still further aspect of the invention, boom controls are placed on the wand to maximize digging rates.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of the invention, in which like numerals denote like elements and in which.

DETAILED DESCRIPTION OF PREFERRED EMBODIMENTS

In this patent document, "comprising" means "including". In addition, a reference to an element by the indefinite article "a" does not exclude the possibility that more than one of the element is present.

Figure 1:
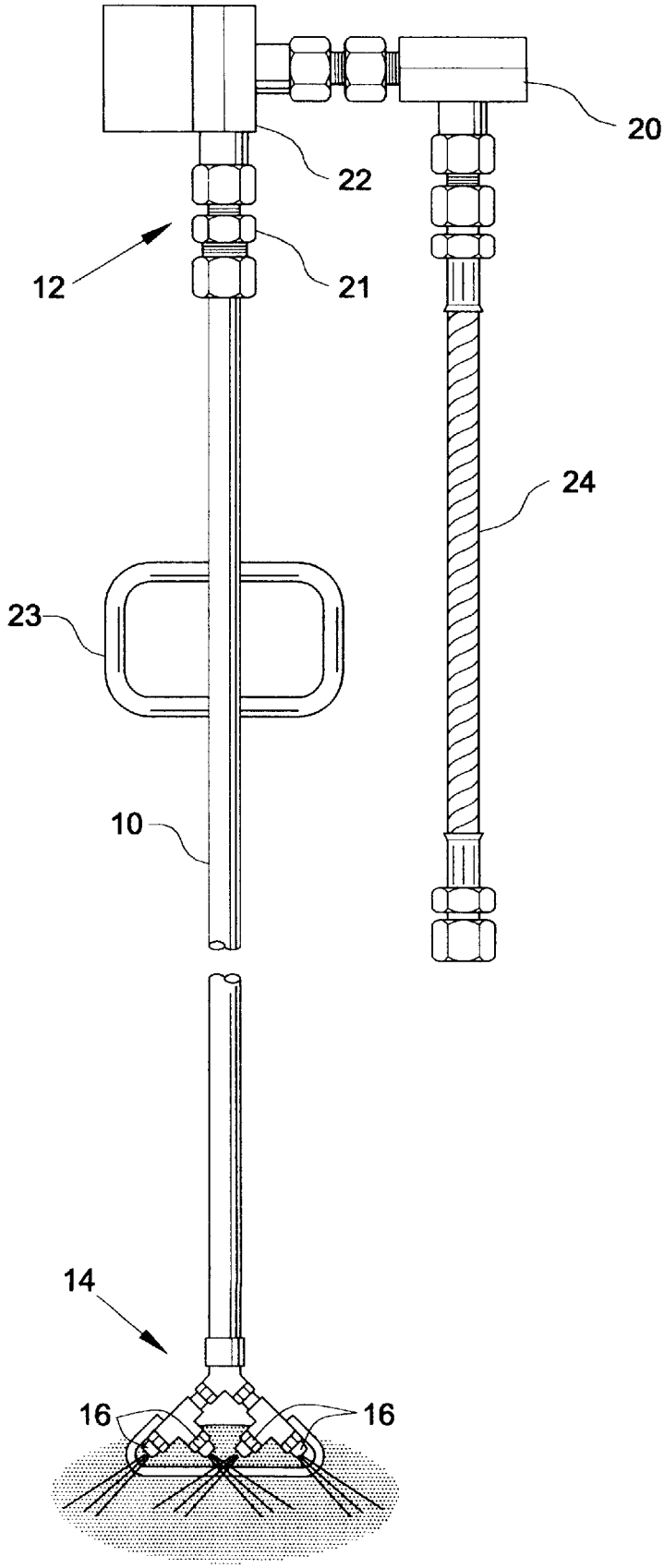
FIG. 1 shows a side view of a hydrovac blast wand according to the invention.
Figure 2:
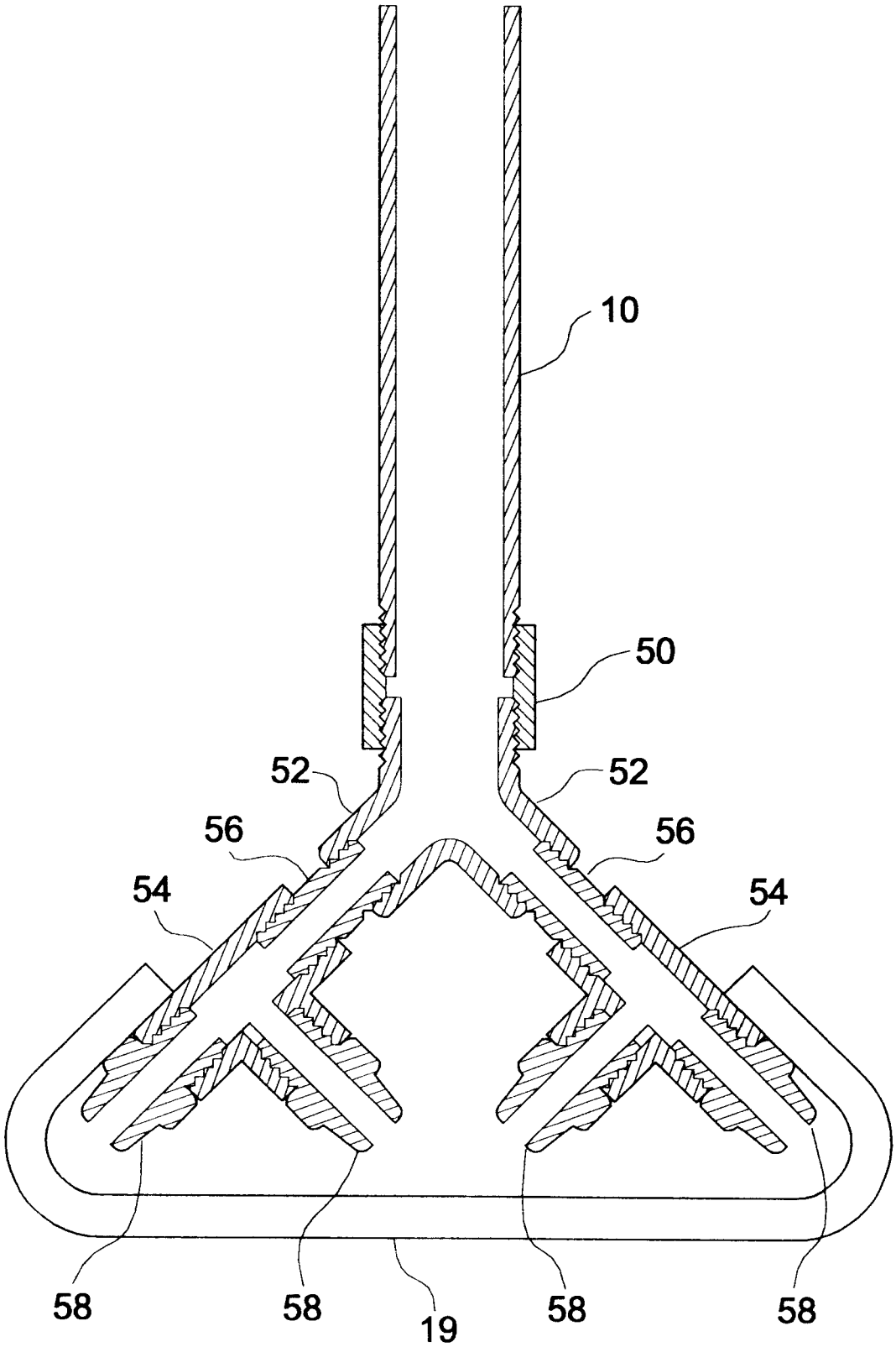
FIG. 2 is a side view of a nozzle arrangement for the hydrovac blast wand of FIG. 1.

In FIG. 1, a hydrovac digging device is formed with a hydrovac blast wand 10 has a control end 12 and digging end 14. At the digging end 14 is a nozzle arrangement formed of two pairs of nozzles 16. Each nozzle 16 is oriented at 45° to the wand axis, and at 90° to the other nozzle in its pair. The nozzles 16 are in symmetric pairs at an angle to the wand axis, that is, the nozzles of a pair have the same angle to the wand axis but are oppositely arranged. In this arrangement, the net thrust due to the nozzles is reduced in the direction of the wand axis to lower than the sum of the thrusts of the nozzles when they are directed in the same direction. It is preferred that the pairs of nozzles are arranged side by side in the same plane. However, other arrangements are possible, and additional nozzles may be used. The difficulty with not having the nozzles symmetrically arranged is that if the thrust imparted by the nozzles is unbalanced, a net sideways force is placed on the wand that is difficult to control. The nozzles need not be at 45° to the wand axis. For example, some slight benefit is obtained if the nozzles are at, say 10°, but the improvement is not great. And, above 45°, the forward thrust becomes unnecessarily reduced for most applications. The nozzles could be made to swivel if desired, for different digging applications. The embodiment shown is two dimensional, with the nozzles arranged in a line. The nozzle arrangement may also be three dimensional, for example with the nozzles forming a four sided pyramid, the hydrovac blast wand being at the apex and the nozzles forming the edges of the pyramid that meet at the apex. Such a nozzle arrangement is more difficult to build. One of the advantageous features of the design shown is that the nozzle arrangement may be simply made with readily available parts. In the embodiment shown, the digging end is formed of a coupling 50 with screw connections to both the wand 10 and screwed ell 52, a pair of screwed tees 54 connected to the screwed ells by nipples 56, and water jets 58 for the nozzles.

Nozzle protection is provided by a rod or rods 19 that are connected as by welding to the nozzles at some convenient point so that the rods 19 are out of the way of the nozzle jets, but still protect the nozzles against banging into hard objects. A handle 23 is provided on the hydrovac blast wand 10 at a convenient location nearer to the control end than the digging end to allow the hydrovac blast wand to be easily manipulated.

Connections are provided at the control end 12 for supplying fluid through the hydrovac blast wand 10 to the nozzle arrangement. A pair of swivels 20, 22, interconnect a high pressure hose 24 and the hydrovac blast wand 10 (through a reducing union 21) to provide a fluid path from the hose to the nozzles. The swivels 20, 22 are oriented at an angle to each other preferably at a right angle. The swivels 20, 22 are readily purchased off the shelf. The hose 24 is also readily commercially available, and may be for example a 10 foot whip of ⅜" hose.

Figure 3:
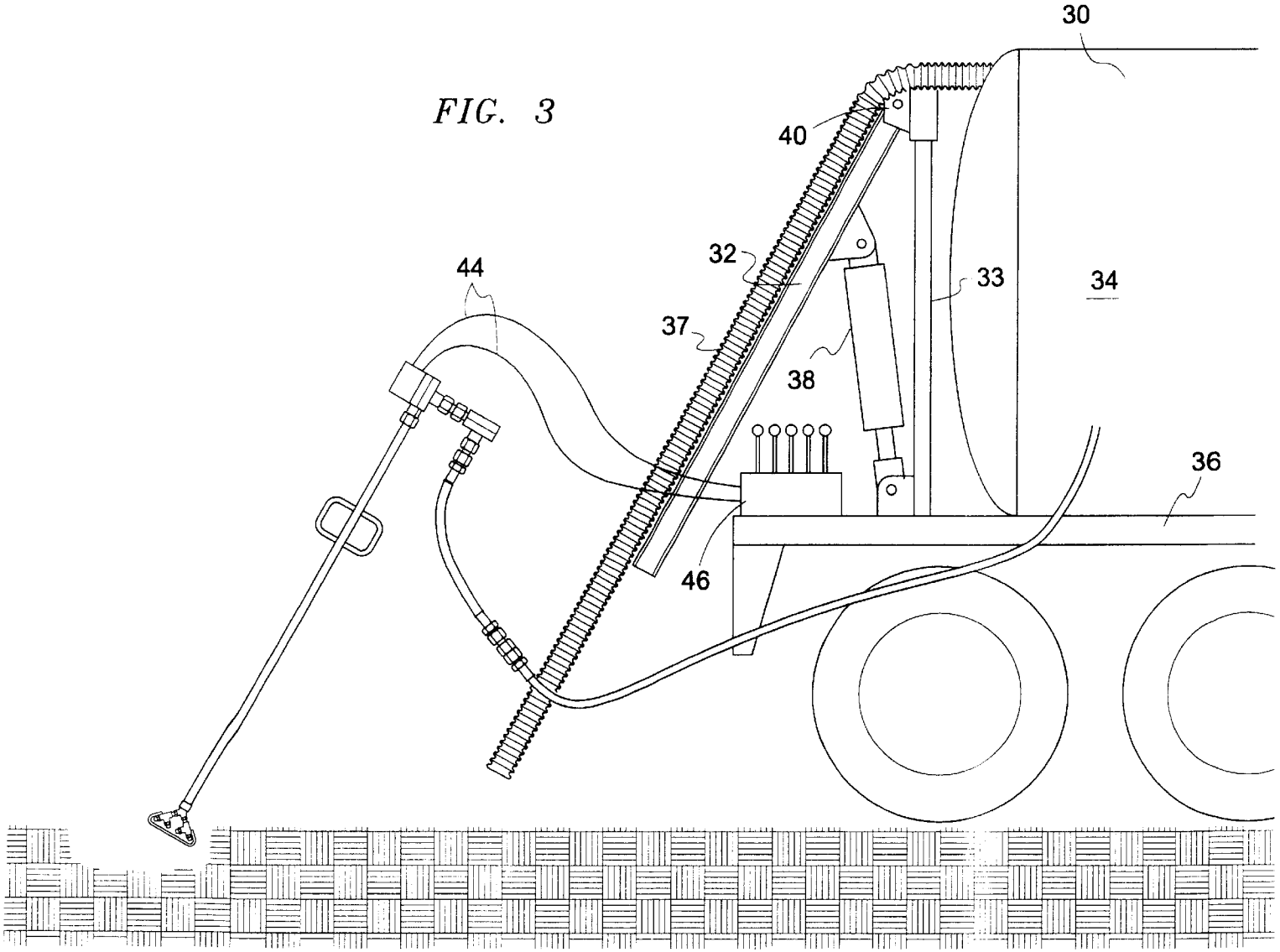
FIG. 3 shows a hydrovac blast wand and hydrovac truck according to the invention showing a first boom position.
Figure 4:
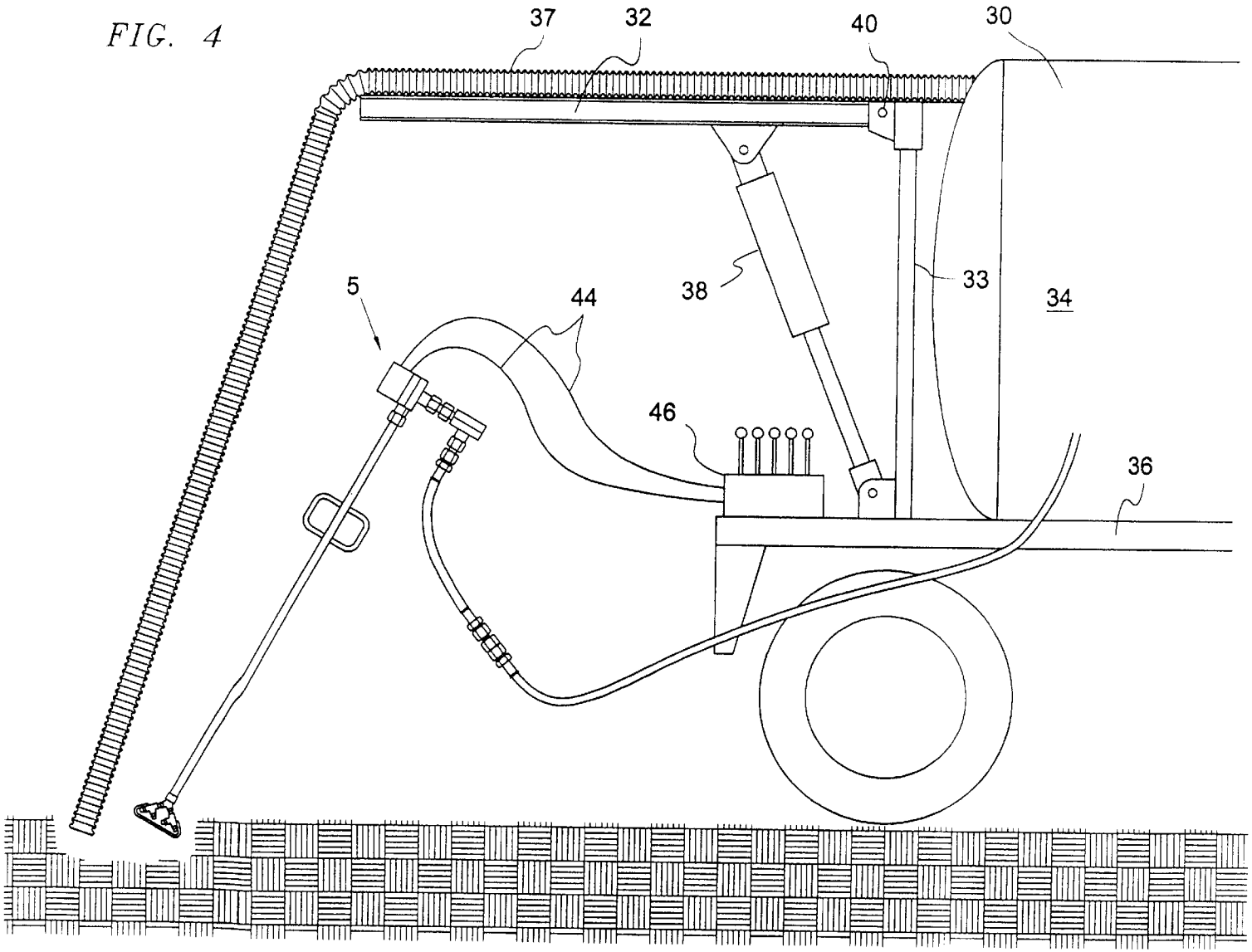
FIG. 4 shows a hydrovac blast wand and hydrovac truck according to the invention showing a second boom position.
Figure 5:
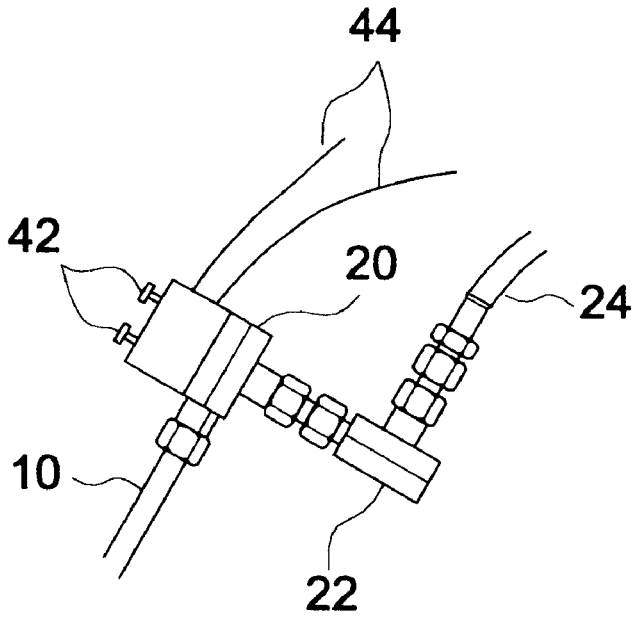
FIG. 5 is a close up of an end of the hydrovac blast wand showing boom controls.

As shown in FIGS. 3 and 4, the hydrovac digging device is used in combination with a hydrovac truck (or trailer) 30 having a boom 32 supported on a boom support 33. The hydrovac truck 30 is conventional, and includes a water tank 34 that sits on the bed 36 of the truck. The boom 32 is movable up and down with hydraulic arm 38 that interconnects the boom 32 and the bed 36 of the truck 30. A vacuum hose 37 is supported by the boom 32 and runs off to the tank 34. The boom 32 is also rotatable about the boom support 33 with a boom rotator 40. Boom controls 42 (FIG. 5) are provided at the control end 12 of the hydrovac blast wand 10. Hydrovac trucks, booms, vacuum hoses, and boom controls are all themselves conventional and not described further here. The location of the boom controls 42 is believed to be novel. Boom control leads 44 run off to the conventional boom and fluid supply control box 46.

The hydrovac blast wand is operated conventionally. The operator holds the wand the handles, while fluid is directed through the nozzles into the soil. The vacuum hose 37 is manipulated with the boom 32 using the boom controls 42 to place the vacuum hose in position to suck up liquified soils. The swivels 20, 22 allow the hydrovac blast wand 10 to be easily moved around in relation to the high pressure hose.

The following materials have been used in an embodiment of the invention:

| Item | Description |
|---|---|
| 10 | ½" SA 106B tube |
| 19 | 3/16" rod bent to shape |
| 20, 22 | ⅜" hydraulic 90° swivel |
| 21 | ½–⅜" reducing union |
| 23 | ½" round bar |
| 24 | SAE 4000 PSI single wound hydraulic hose |
| 50 | ½" half coupling 3000# rating NPT ends SA105 |
| 52 | ¼" 90° elbow 3000# rating NPT ends SA105 |
| 54 | ¼" equal 3000# rating NPT ends SA105 |
| 56 | ¼" SA106B tube 1" LG |
| 58 | ¼" TECSI-¼"-MC4-04/0 water jets |

Immaterial modifications may be made to the invention described here without departing from the essence of the invention.

The embodiments of the invention in which an exclusive property or privilege is claimed are defined as follows:

1. A hydrovac digging device in combination with a hydrovac truck having a boom and a water tank, the hydrovac digging device comprising:

a hydrovac blast wand having a digging end and a control end;

a nozzle arrangement at the digging end;

a hose connected to the water tank of the hydrovac truck;

connections at the control end of the hydrovac blast wand, the connections being connected to the hose for supplying fluid through the hydrovac blast wand to the nozzle arrangement; and boom controls on the hydrovac blast wand at the control end of the hydrovac blast wand.

2. The hydrovac digging device in combination with a hydrovac trick having a boom and a water tank of claim 1 in which the nozzle arrangement comprises nozzles oriented at an angle to each other to provide a net thrust in a digging direction that is less than the sum of the thrusts imparted by the nozzles.

3. The hydrovac digging device in combination with a hydrovac truck having a boom and a water tank of claim 2 in which the nozzles are symmetrically arranged with respect to an axis of the hydrovac blast wand.

4. The hydrovac digging device in combination with a hydrovac truck having a boom and a water tank of claim 3 in which the nozzles include a first pair of nozzles oriented at 90° to each other and each at 45° to the wand axis.

5. The hydrovac digging device in combination with a hydrovac truck having a boom and a water tank of claim 4 in which the nozzles include a second pair of nozzles oriented at 90° to each other and each at 45° to the wand axis.

6. The hydrovac digging device in combination with a hydrovac truck having a boom and a water tank of claim 5 in which the first pair of nozzles and the second pair of nozzles are oriented side by side in the same plane.

7. The hydrovac digging device in combination with a hydrovac truck having a boom and a water tank device of claim 2 in which the connections at the control end of the hydrovac blast wand comprise:

a high pressure hose; and a pair of swivels interconnecting the high pressure hose and the hydrovac blast wand, the pair of swivels being oriented at an angle to each other.

8. The hydrovac digging device in combination with a hydrovac truck having a boom and a water tank of claim 7 in which the pair of swivels are oriented at 90° to each other.

9. The hydrovac digging device in combination with a hydrovac truck having a boom and a water tank device of claim 1 further comprising a nozzle protection cage surrounding the nozzle arrangement.

* * * * *